US009556711B2

(12) United States Patent
Ward

(10) Patent No.: US 9,556,711 B2
(45) Date of Patent: Jan. 31, 2017

(54) FUNNEL SYSTEM AND METHOD

(75) Inventor: Scott D. Ward, Houston, TX (US)

(73) Assignee: One Subsea IP UK Limited, London (GB)

( * ) Notice: Subject to any disclaimer, the term of this patent is extended or adjusted under 35 U.S.C. 154(b) by 1051 days.

(21) Appl. No.: 12/668,882

(22) PCT Filed: May 19, 2008

(86) PCT No.: PCT/US2008/064147

§ 371 (c)(1),
(2), (4) Date: Jan. 12, 2010

(87) PCT Pub. No.: WO2009/014794

PCT Pub. Date: Jan. 29, 2009

(65) Prior Publication Data

US 2010/0200241 A1 Aug. 12, 2010

Related U.S. Application Data

(60) Provisional application No. 60/951,670, filed on Jul. 24, 2007.

(51) Int. Cl.
*E21B 41/00* (2006.01)

(52) U.S. Cl.
CPC ..... *E21B 41/0014* (2013.01)

(58) Field of Classification Search
USPC ..... 166/339–345, 39, 365, 81.1
See application file for complete search history.

(56) References Cited

U.S. PATENT DOCUMENTS

| | | | | |
|---|---|---|---|---|
| 3,475,038 | A * | 10/1969 | Matherne | 285/27 |
| 3,744,561 | A | 7/1973 | Shatto et al. | |
| 3,789,922 | A | 2/1974 | Knief | |
| 4,175,620 | A * | 11/1979 | Nolan et al. | 166/343 |
| 4,805,951 | A * | 2/1989 | Andersson et al. | 294/116 |
| 5,251,541 | A * | 10/1993 | Anson et al. | 99/280 |
| 5,284,213 | A | 2/1994 | Nobileau | |
| 5,320,175 | A * | 6/1994 | Ritter et al. | 166/339 |
| 5,817,066 | A * | 10/1998 | Goforth | 604/212 |
| 6,408,949 | B1 * | 6/2002 | Aquilera et al. | 166/368 |
| 6,470,973 | B1 * | 10/2002 | Rangnes et al. | 175/7 |
| 6,766,861 | B2 * | 7/2004 | Koen et al. | 166/345 |
| 7,237,607 | B2 * | 7/2007 | Angman et al. | 166/85.5 |
| 7,422,066 | B2 * | 9/2008 | Rodrigues et al. | 166/341 |

(Continued)

FOREIGN PATENT DOCUMENTS

| | | |
|---|---|---|
| GB | 2004581 | 4/1979 |
| GB | 2212189 | 7/1989 |
| WO | WO2006046851 | 5/2006 |

OTHER PUBLICATIONS

PCT International Search Report and Written Opinion for PCT/US2008/064147, dated Jul. 10, 2009.

*Primary Examiner* — Matthew R Buck
*Assistant Examiner* — Aaron Lembo
(74) *Attorney, Agent, or Firm* — Fletcher Yoder, P.C.

(57) ABSTRACT

A system in some embodiments includes a two-part funnel that guides a first component to engage or connect with a second component of a mineral extraction system. The two-part funnel having a first funnel portion, and a second funnel portion, wherein the second funnel portion is configured to be disposed in at least two positions relative to the position of the first funnel portion.

14 Claims, 7 Drawing Sheets

(56) References Cited

U.S. PATENT DOCUMENTS

| | | | | |
|---|---|---|---|---|
| 2003/0051877 | A1* | 3/2003 | Koen et al. | 166/339 |
| 2003/0205381 | A1 | 11/2003 | Stromberg et al. | |
| 2006/0231266 | A1* | 10/2006 | Rodrigues et al. | 166/365 |

* cited by examiner

FUNNEL SYSTEM AND METHOD

CROSS-REFERENCE TO RELATED APPLICATIONS

This application claims priority to and benefit of PCT Patent Application No. PCT/US2008/064147, entitled "Funnel System and Method," filed May 19, 2008, which is herein incorporated by reference in its entirety, and which claims priority to and benefit of U.S. Provisional Patent Application No. 60/951,670, entitled "Funnel System and Method", filed on Jul. 24, 2007, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Wells are often used to access mineral resources below the surface of the earth. For instance, oil, natural gas, and water are often extracted via wells. Wells generally include various mechanisms for drilling and recovery of the mineral resources. For instance, a well is generally drilled from the earth's surface into a deposit of mineral resources. Once the mineral resources are reached, a sub-surface well-bore provides a path between the mineral deposit and the surface. Generally, the sub-surface well-bore terminates into a wellhead that is capped off with what is referred to as a "christmas tree" at or near the surface. The tree generally includes various paths for the minerals to be extracted through, as well as numerous valves and controls to regulate the flow of the minerals. Wells may be located on land (e.g., surface systems) and under the surface of the water (e.g., offshore and subsea systems). With the advance of technology, subsea systems are being drilled and completed in oceans, seas, the Gulf of Mexico, and the like. In certain subsea systems, wells may be located on the ocean floor at depths exceeding 10000 feet.

A well located on the ocean floor may create additional difficulties and costs, such as those relating to installation and maintenance. For instance, if a well is drilled on the ocean floor, a christmas tree and other subsea system components (e.g., a manifold) are generally attached to the wellhead at or near the ocean floor. Accordingly, tools and various equipment are often lowered from the surface (e.g., an offshore vessel) to the ocean floor for installation, operation, and maintenance of the tree and the other system components. However, at increased depths, the fluid pressures may be so great that direct human interaction (e.g., a diver) at the depth of the system in not feasible. Thus, devices and components are lowered, operated and/or retrieved via cables, drill pipe, or a remote operated vehicle (ROV), for instance. Unfortunately, aligning and operating tools from the platform or other remote locations may introduce increased difficulties relating to alignment of various components. As a result, performing installation, operation and maintenance of the system may involve an increased amount of time and effort.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Certain exemplary embodiments of the present invention include a funnel system that addresses one or more of the above-mentioned inadequacies of conventional subsea extraction systems. As explained in greater detail below certain embodiments include a two-part funnel, which has a portion of the funnel that can be rotated and/or repositioned such that the funnel system does not interfere with other components of the extraction system. In some embodiments, a first portion of the funnel system may be coupled to a second portion of the funnel system via a hinge, such that the first portion of the funnel can be rotated to reduce potential interference with other components. Further, certain embodiments may include a two-part funnel that has a telescopic configuration, such that a portion of the funnel slides relative to another portion of the funnel in a coaxial manner. Additionally, certain embodiments may include a latching mechanism to prevent the funnel system from inadvertently rotating and/or sliding.

Figure 1:
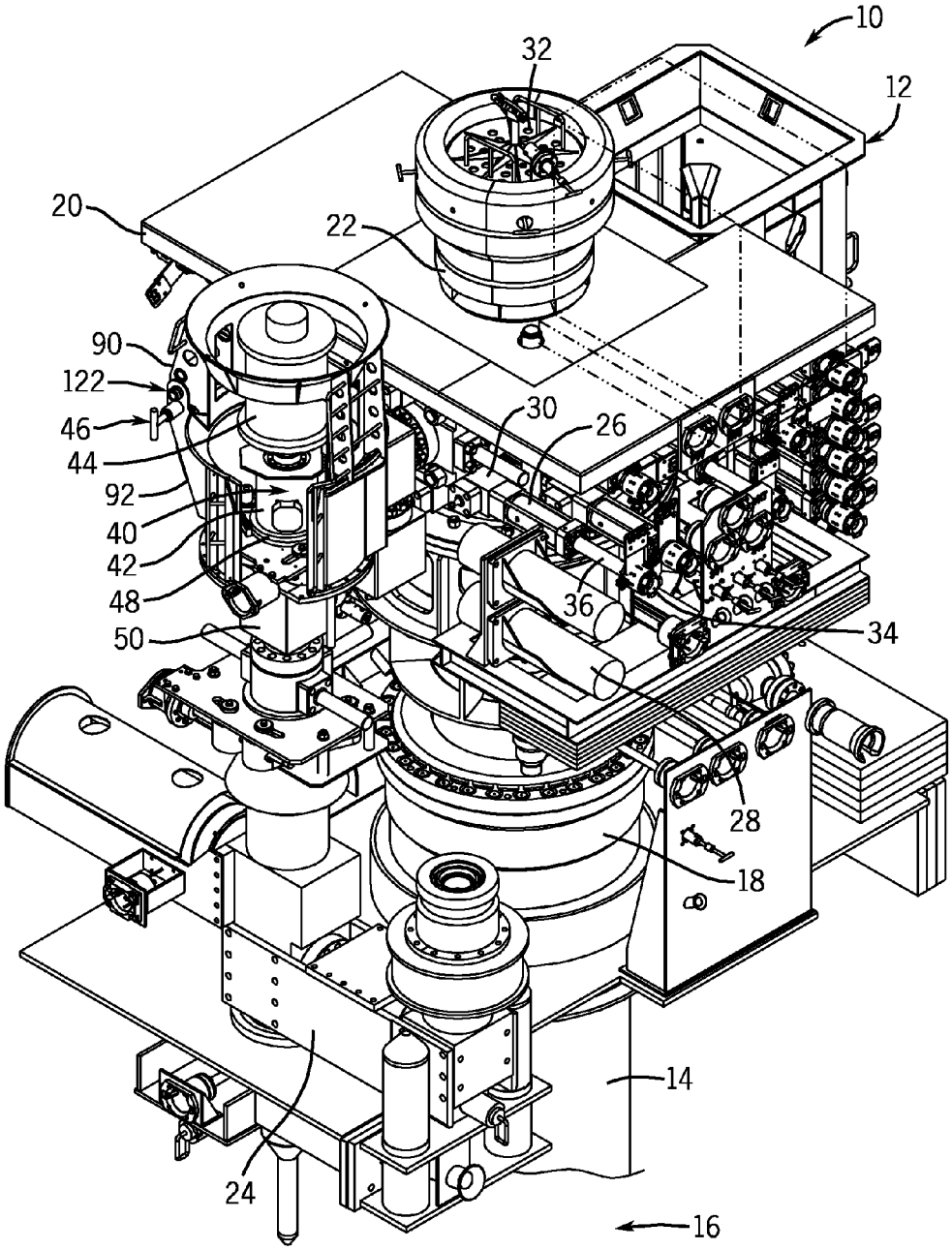
FIG. 1 is a perspective view of an exemplary mineral extraction system having a multi-part funnel in accordance with an embodiment of the present technique.

FIG. 1 illustrates a mineral extraction system 10. The illustrated resource extraction system 10 can be configured to extract various minerals, including hydrocarbons (e.g., oil and/or natural gas). In some embodiments, the resource extraction system 10 may be land-based (e.g., a surface system) or subsea (e.g., a subsea system). Further, the system 10 may be configured to extract minerals and/or inject other substances. As illustrated, the system 10 includes what is colloquially referred to as a christmas tree 12 (hereinafter, a tree) and a wellhead hub 14. Generally, the wellhead hub 14 includes a large diameter hub that provides a connection to a sub-surface well bore extending from the surface 16 (e.g., ground or ocean floor) to a reservoir of minerals, such as oil and natural gas, located below the surface 16. For instance, in one embodiment, the wellhead hub 14 includes a DWHC (Deep Water High Capacity) hub manufactured by Cameron, headquartered in Houston, Tex.

The tree 12 may attach to the wellhead hub 14 via a tubing head spool 18 that includes a collet connector internal to the tubing head spool 18. For instance, the collet connector may include a DWHC connector, also manufactured by Cameron. Generally, the tree 12 is coupled to the wellhead hub 14 via the tuning head spool 18 and various connectors.

When assembled, the tree 12 may include a variety of flow paths (e.g., bores), valves, fittings, and controls for operating the well. For instance, the depicted tree 12 includes a frame 20 that is disposed about a tree body 22, a flow-loop 24, actuators 26, hydraulic/electric actuators 28, and valves 30. Generally, the tree body 22 includes a well bore 32 that provide access to the well head hub 14 and the sub-surface well bore. Access to the sub-surface well bore may provide for various operations, such as the insertion of tubing into the well, the injection of various chemicals into the well (down-hole), as well as other completion and workover procedures. Further, the flow-loop 24 may include an additional bore in fluid communication with the well bore 32, the wellhead hub 14, and/or the subsurface well bore. When minerals, such as oil and natural gas, are extracted from the well, they may be routed via the flow-loop 24. For instance, the output of the flow-loop 24 is generally coupled to a jumper or a flowline that is tied back to other components, such as a manifold. Accordingly, produced minerals may flow from the well to the manifold before being routed to shipping or storage facilities. In operation, a single manifold may gather and route mineral production from multiple mineral extraction systems 10.

The flow of minerals, gases, and fluids within the mineral extraction system 10 and the tree 12 is generally regulated by the actuators 26 and valves 30. In certain embodiments, the valves 30 are configured such that they may open or close, and, thus, enable or cut-off flow in a bore or channel regulated by the valve 30. Certain valves 30 may include actuators 26 that are manually operated while others may include hydraulic/electric actuators 28. Manually operated actuators 26 generally interact with an ROV or other external source of mechanical power to operate (e.g., open or close) the valve 30. For instance, an ROV may extend an arm into an ROV bucket 34 that surrounds a stem 36 extending from the actuator 26. The ROV may, then, rotate the stem 36 to operate a mechanism (e.g., a screw) within the actuator 26, and, in turn, close or open the valve 30. In the case of a hydraulic actuator 28, the system 10 or ROV may provide the actuator 28 with pressurized hydraulic fluid to operate the valve 30. However, in certain circumstances (e.g., a manual override), the hydraulic actuator 28 may be operated in a similar manner as the actuator 26. An electric actuator 28 may be operated via electrical power. For example, power may be supplied from a remote location, or via a battery.

The system 10 includes a choke valve 40 (herein after referred to as the choke 40) located in line with the flow loop 24. The choke 40 provides for regulation of the flow of mineral production through the flow loop 24 to the jumper or other external connections. Similar to the valves 30 described above, the depicted choke 40 includes a hydraulic choke actuator 42 that may be operated to open or close the choke 40 to regulate flow through the flow loop 24. Generally operating the choke 40 includes providing a pressurized hydraulic fluid to open or close the choke 40. In one embodiment, the choke actuator 42 includes a hydraulic stepping Aqua Torq actuator provided by Cameron. For example, the Aqua Torq actuator may use 180 hydraulic pulses to operate the choke 40 from full open to full close. In such a configuration, operating the Aqua Torq actuator may take approximately 30 minutes to transition between fully open position and the fully closed position.

To ensure a particular rate of closure of the choke 40, a Subsea Choke Fast Acting Module (FAM) 44, manufactured by Cameron, may be added to the system 10. As depicted, the FAM 44 is disposed on top of the choke 40 such that it may engage a stem or other coupling device extending from the top of the choke 40. The FAM 44 may be operated such that the choke 40 opens or closes within 30 seconds via a single hydraulic pulse. The ability to quickly shut-off the flow of production may minimize the wear on valves 30 in the tree 12 as well as other down-hole valves.

As with various components of the system 10, the FAM 44 and the choke 40 may be installed, or removed from, the system 10 after the tree 12 has been installed subsea (e.g., on or near the ocean floor). Therefore, each component may be lowered from the surface (e.g., an offshore vessel) to the ocean floor for installation, operation, and maintenance. However, at increased depths, such as those of deep-water systems 10, the fluid pressures may be so great that direct human interaction (e.g., a diver) at the depth of the installed system 10 is not feasible. This concern is also prevalent for other components of the system 10. Thus, devices and components, such as the choke 40 and FAM 44 are lowered, operated and/or retrieved from the ocean floor via cables, drill pipe, and/or a remote operated vehicle (ROV), for instance. Unfortunately, aligning and operating tools from the platform, or other remote locations, may introduce difficulties relating to aligning and engaging various components. As a result, performing installation, operation and maintenance of components may take an increased amount of time and effort.

To improve the efficiency and ability to properly align and engage components in certain environments, such as the subsea environment, the system 10 may include a funnel at or near the point of engagement between components. The funnel may aid in guiding components into alignment and/or connection, and, thus, reduce the level of difficulty. Further, the addition of a funnel may provide additional protection of installed components. As depicted, the system 10 includes a multi-part funnel assembly 46 disposed about the choke 40 and FAM 44. For example, the funnel assembly includes a funnel extension 90 and a funnel bucket 92. The funnel assembly 46 aids in the alignment of the choke actuator 42 to a choke flange 48 and a choke body 50, and, further, aids in alignment of the FAM 44 to the choke 40.

Figure 2:
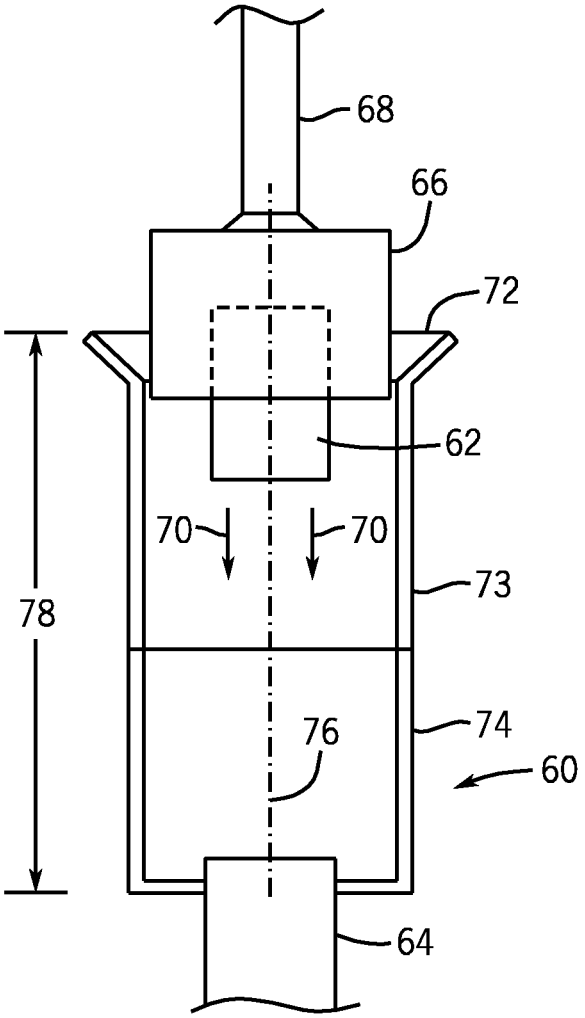
FIG. 2 is a block diagram illustrating the operation of the funnel of FIG. 1.

FIG. 2 includes a diagram illustrating the general operation of a two-part funnel assembly 60. As depicted, a first component 62 (e.g., choke actuator 42 or FAM 44), may be aligned for engagement with a second component 64 (e.g., choke actuator 42 or FAM 44). Generally, the first component 62 is lowered to the funnel 60 from the surface (e.g., platform). The first component 62 may be lowered via a running tool 66 for instance. The running tool 66 may provide an interface between the first component 62 and a drill pipe 68, or other device, such as a cable or ROV, used to lower the first component 62 to the funnel 60. As the first component 62 is lowered in the direction of arrows 70, a surface of the first component 62 or the running tool 66 may contact and engage a chamfer 72 of an extension 73 of the funnel assembly 60. As the first component 62 continues to be lowered in the direction of the arrows 70, the chamfer 72 may catch the first component 62 and/or the running tool 66, and guide them into a body 74 of the funnel 60. Lowering the running tool 66 and the first component 62 into the body 74 may continue to align the components with a centerline 76, such that the first component 62 and the second component 64 are generally aligned (e.g., coaxial) for engagement. The first component 62 may continue to be lowered until it engages the second component 64. After the first component 62 and the second component 64 are engaged, the running tool 66 may provide various operations to complete the engagement (such as activating hydraulic and mechanical locking mechanisms), and then be released from the first component 62 and retrieved to the surface via the drill pipe 68.

Generally, a height 78 of the funnel assembly 60 is selected based on the length of the component 62 to be aligned. For example, as the length of the first component 62 increases, the height 78 of the funnel assembly 60 may be increased to enable the funnel assembly 60 to catch and align the component 62 prior to its engagement with the second component 64. As depicted in FIG. 2, the height 78 of the funnel 60 may be increased such that the running tool 66 engages the funnel chamfer 72 and the body 74 prior to engagement of the first component 62 to the second component 64. For instance, if the FAM 44 is attached to the choke 40, a taller funnel 60 may be desirable to accommodate the increased length of the FAM 44.

Although increasing the height 78 of the funnel assembly 60 may aid in aligning and protecting the components 62 and 64, the height 78 of the funnel 60 may be limited by other factors. For instance, increasing the height 78 may increase the potential for interference with other components of the system 10. For example, returning now to FIG. 1, various devices and tools are coupled to the tree 12 during installation, operation, and workover procedures. Specifically, certain workover procedures include coupling a blow-out preventer (BOP) stack to the tree body 22. Generally, a BOP stack includes a plurality of valves, actuators and other components coupled to a central body of the BOP. The actuators, valves, and components typically extend outward from the BOP stack. Thus, when the BOP stack is lowered onto the tree body 22, clearance may be desired near the top portion of the tree 12. Specifically, when the BOP is coupled to the tree 12, the actuators, valves and other components may be lowered such that they are near the top of the frame 20 and extend in a radial direction. Accordingly, a portion of the funnel assembly 46 that extends above the top of the tree frame 20 may interfere with or block installation of the BOP stack, and the like. Thus, it is desirable that the funnel assembly 46 provides for alignment of components of the system 10, and has minimal interference with other components of the system 10. As discussed below, the funnel assembly 46 may include a multi-part and/or movable funnel structure, where at least a portion of the funnel 46 may be relocated such that it reduces the potential for interference with other components of the system 10.

Figure 3:
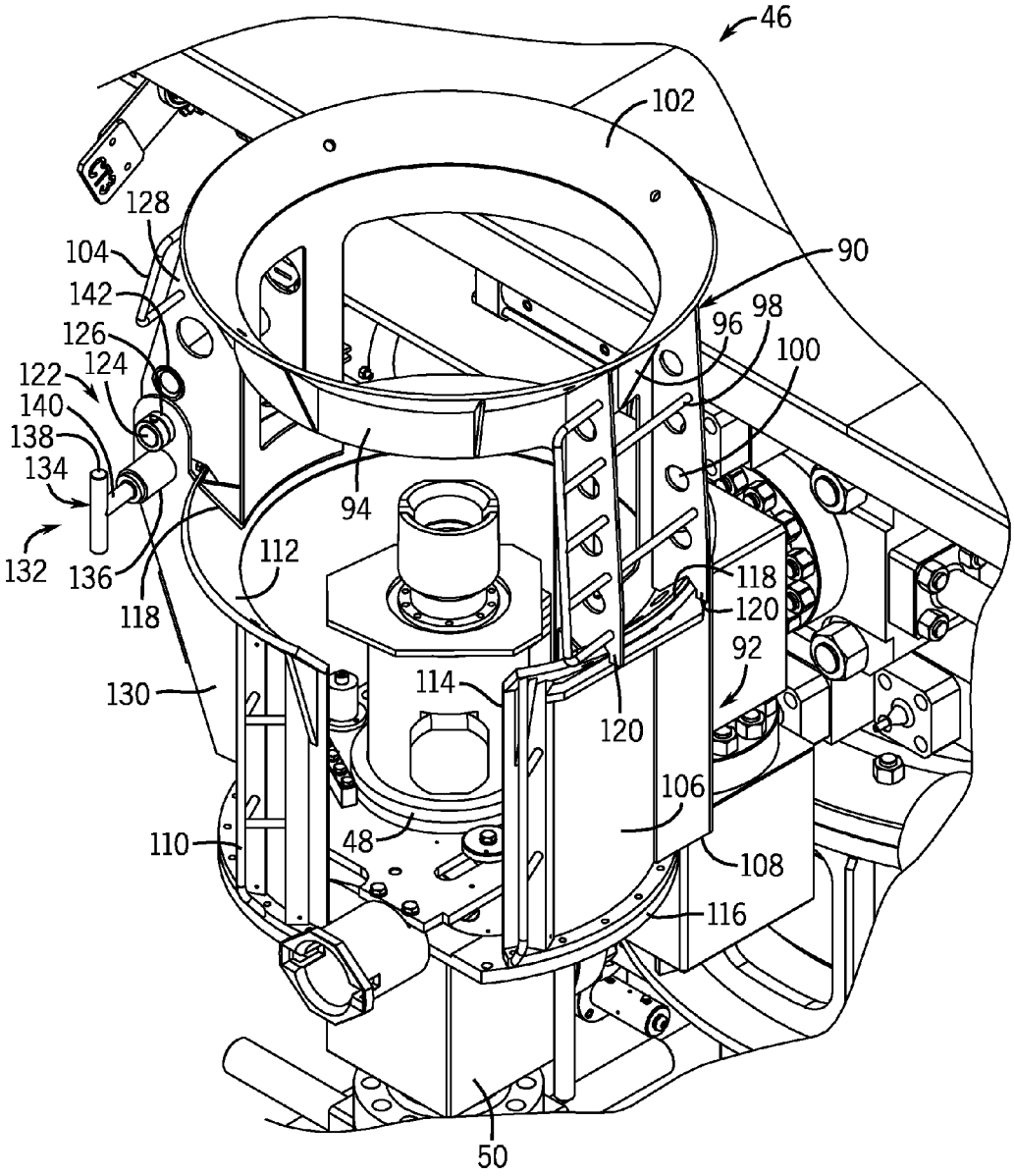
FIG. 3 is a perspective view of the funnel of FIG. 1 wherein a first funnel portion is stacked over a second funnel portion.

FIG. 3 illustrates a perspective view of the funnel assembly 46 of FIG. 1 that includes two-parts in accordance with certain embodiments of the present technique. For example, the funnel assembly 46 includes the funnel extension 90 (e.g., a first hollow funnel portion) and the funnel bucket 92 (e.g., a second hollow funnel portion). In certain embodiments the extension 90 includes various features that are beneficial to subsea extraction systems 10. For example, the extension 90 includes a cylindrical extension body 94, a plurality of ribs 96 to increase mechanical strength of the extension 90, a ROV handles 98 for ease of access, various cutouts 100 to reduce the overall weight of the extension 90, a chamfer 102 (e.g., conical portion) to increase the area for engaging a component to be aligned, and a handle 104 for manipulating the position of the extension 90. Similarly, the bucket 92 includes a cylindrical bucket body 106, a plurality of ribs 108, handles 110, and a bucket chamfer 112 (e.g., conical portion). Further, the bucket 92 includes an access cutout 114 that provides clearance for the assembly of additional tools or components to the system 10.

As illustrated in FIGS. 1 and 3, the bucket 92 includes a portion of the funnel 46 that connects proximate to the component to be engaged. For example, the bucket 106 is coupled to choke flange 48 and the choke body 50 via a base 116. Accordingly, the bucket 92 may be fixed relative to choke 40, and, therefore, provides for consistent and accurate alignment of a component (e.g., the choke actuator 42 and/or the FAM 44) to the choke 40. In other embodiments, the bucket 92 may be fixed relative to components in other configurations. For example, the bucket 92 may be coupled directly to the component to be aligned (e.g., the choke 40), or may be fixed via a remote connection. The bucket 92 may be mounted to the tree frame 20 in a position in relative alignment with the component to be aligned with the bucket 92, for instance.

Further, FIGS. 1 and 3 illustrate the funnel 46 including the funnel extension 90 disposed atop the bucket 92 in a first position. In other words, the funnel extension 90 and the bucket 92 are coaxial with one another and are axially stacked one over another in the first position. For example, feet 118 of the extension 90 rests in the bucket chamfer 112 such that the extension 90 is supported by the bucket 92 and extends above the bucket 92. Generally, the extension 90 increases the overall height of the funnel 46. In one embodiment, the feet 118 include a tapered metal surface generally contoured to match the angle and curvature of the bucket chamfer 112, and, thus, to provide for alignment of the extension 90 relative to the bucket 92. The feet 118 may also include other features, such as spacers or rubber pads to aid in alignment and positioning. For example, the depicted embodiment includes hooks 120 (see FIG. 4) that capture an edge of the bucket chamfer 112. Other embodiments may include various configurations to support, align, and mount the extension 90. For example, one embodiment may include a lip that runs along the circumference of the bucket 92 and a complementary lip on the extension 90, such that the extension 90 rest on the bucket 92 via the lip.

Figure 4:
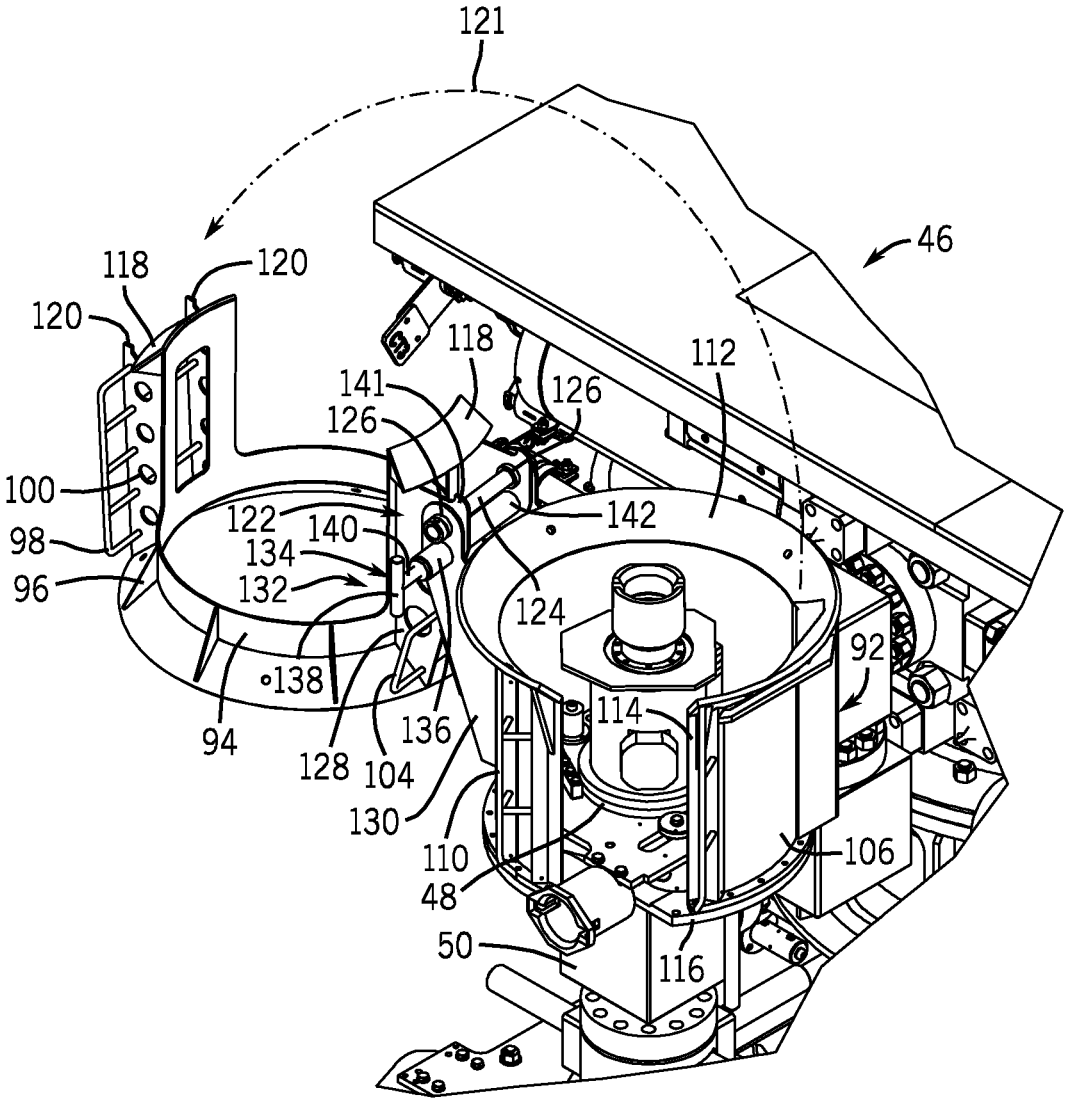
FIG. 4 is a perspective view of the funnel of FIG. 1, wherein a first funnel portion is rotated side-by-side relative to a second funnel portion.
Figure 5:
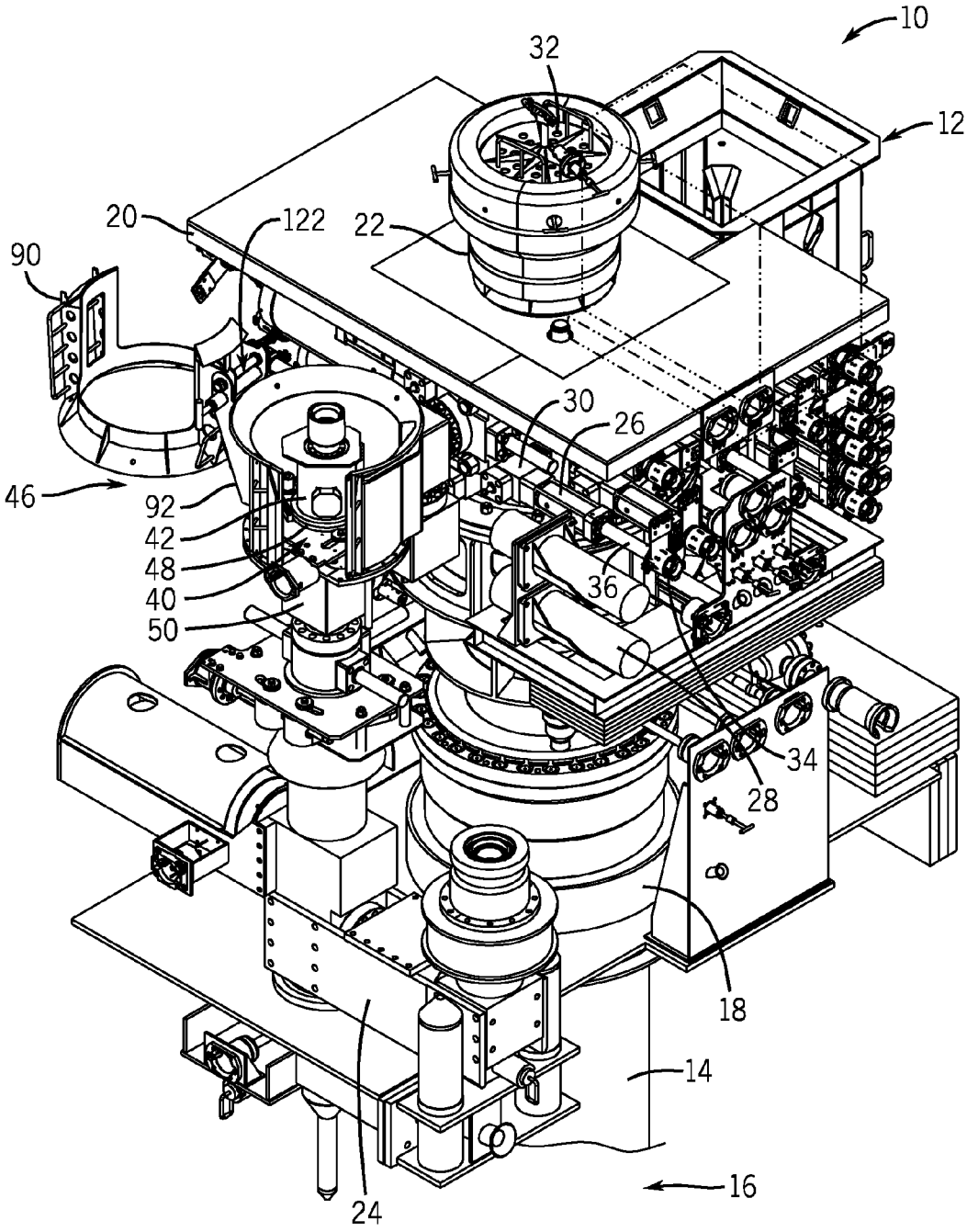
FIG. 5 is a perspective view of the exemplary resource extraction system of FIG. 1, wherein a first funnel portion is rotated side-by-side relative to a second funnel portion.

FIG. 4 illustrates the funnel 46 of FIGS. 1 and 3, wherein the extension 90 is rotated along arrow 121 to a second position. In other words, the extension 90 is rotated such that the overall height of the funnel 46 is reduced, and, thus, the potential for interference with other components is also reduced. For example, as illustrated in FIG. 5, the funnel 46 includes an extension 90 rotated to a second position such that additional components (e.g., BOP stack) may be landed on the top portion of the tree 12 without interference of the funnel 46.

In one embodiment, the funnel assembly 46 includes a hinge 122 that enables the funnel 90 to be rotated. For example, as illustrated in FIGS. 3 and 4, the funnel 90 is rotated vertically about the horizontally disposed hinge 122 (e.g., horizontal axis of rotation). In the depicted embodiment, the hinge 122 includes a hinge pin 124 disposed through a hinge receptacle 126. The hinge receptacle 126 includes a longitudinal set of holes that pass through an extension gusset 128 of the extension 90, and through a bucket gusset 130 of the bucket 92. Accordingly, the funnel assembly 46 may be rotated about the hinge 122 to a full-height configuration, as depicted in FIGS. 1 and 3, as well as rotated to a reduced-height configuration as illustrated in FIGS. 4 and 5. Embodiments may include other variations of the hinge mechanism 122. For example, multiple hinges 122 may be employed. In another embodiment, the hinge mechanism 122 may not be coupled to the bucket 92. For example, the extension 90 may be coupled to the frame 20 via the hinge 122, and include at least one rotated position that is aligned with the bucket 92.

The funnel assembly 46 also includes a locking mechanism 132 that may prevent the funnel extension 90 from inadvertently shifting between full-height and reduced-height positions. For example, as depicted in FIGS. 3 and 4, the locking mechanism 132 includes a latch pin 134 that is passed through a latch pin receptacle 136. The latch pin 134 includes a latch handle 138, and a latch stem 140. The latch handle 138 provides for insertion or removal of the latch pin 134, such as removal by an ROV. The latch stem 140 includes a shaft that is passed through the latch pin receptacle 136 and blocks rotation of the extension 90. For example, when the extension 90 is in a full-height configuration (see FIG. 3) and the latch pin 134 is inserted into the receptacle 136, the hooks 141 (see FIG. 4) block the extension 90 from rotating. Further, when the extension 90 is rotated to a half-height configuration and the latch pin 134 is inserted into the receptacle 136, the stem 140 passes through locking receptacles 142, such that the extension 90 can not be rotated. Other embodiments may include any number of locking mechanisms 132 that are configured to resist movement of the extension 90 and/or the bucket 92 relative to one another.

Figure 6:
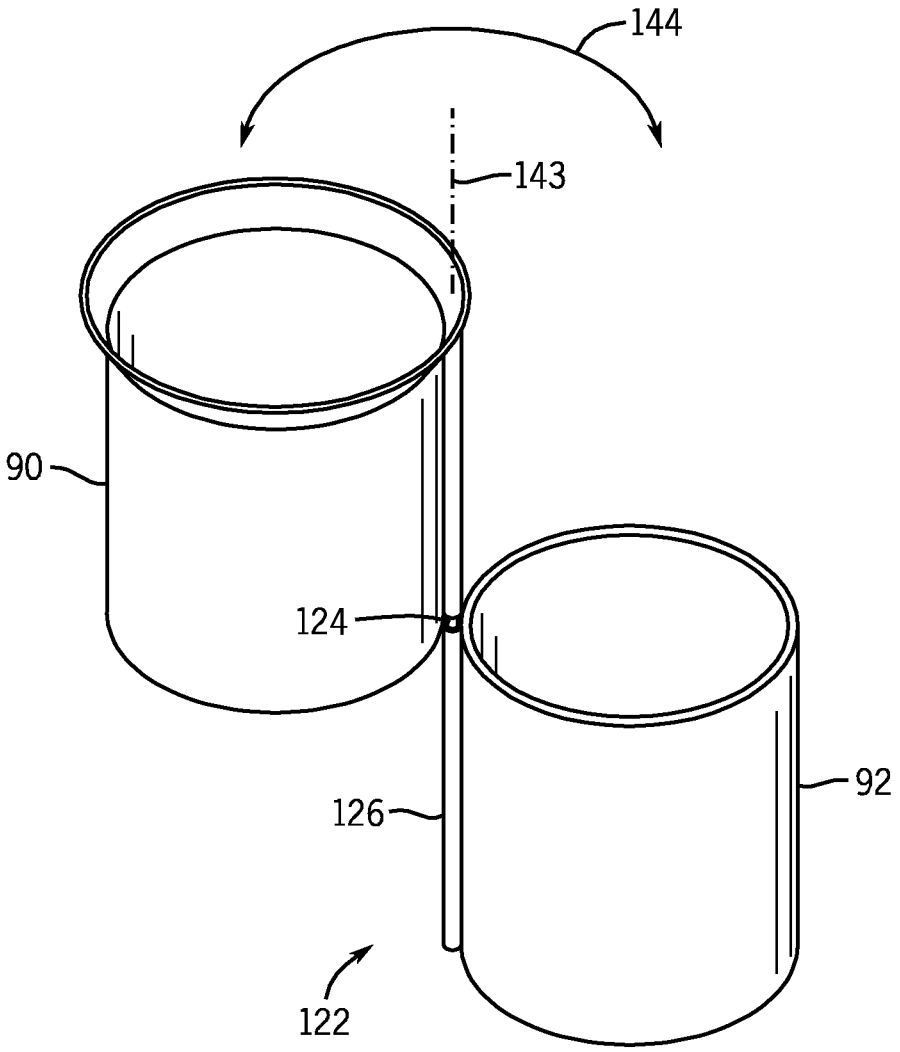
FIG. 6 is a perspective view of another embodiment of the funnel of FIG. 1.

FIG. 6 illustrates an embodiment of the funnel 46 that includes rotating the extension 90 about an axis running parallel to the longitudinal axis of the bucket 92. For example, the funnel 46 includes a vertically oriented hinge 122 that is disposed generally tangent to external surfaces of the bucket 92 and the extension 90. Accordingly, the extension 90 may be rotated in a horizontal plane about a vertical axis 143. Thus, similar to the previously discussed embodiments, the extension 90 may be manipulated from a first position where the extension 90 is aligned (e.g., coaxial and/or vertically stacked) with the bucket 92, to a second position (e.g., off-axis and/or side-by-side) to reduce potential interferences with other components of the system 10 (e.g., a BOP stack). The rotational path of the extension 90 is generally represented by arrow 144. Similar embodiments may include the addition of a locking mechanism, feet, gussets, and the like to provide flexibility and functionality of the funnel 46.

Figure 7:
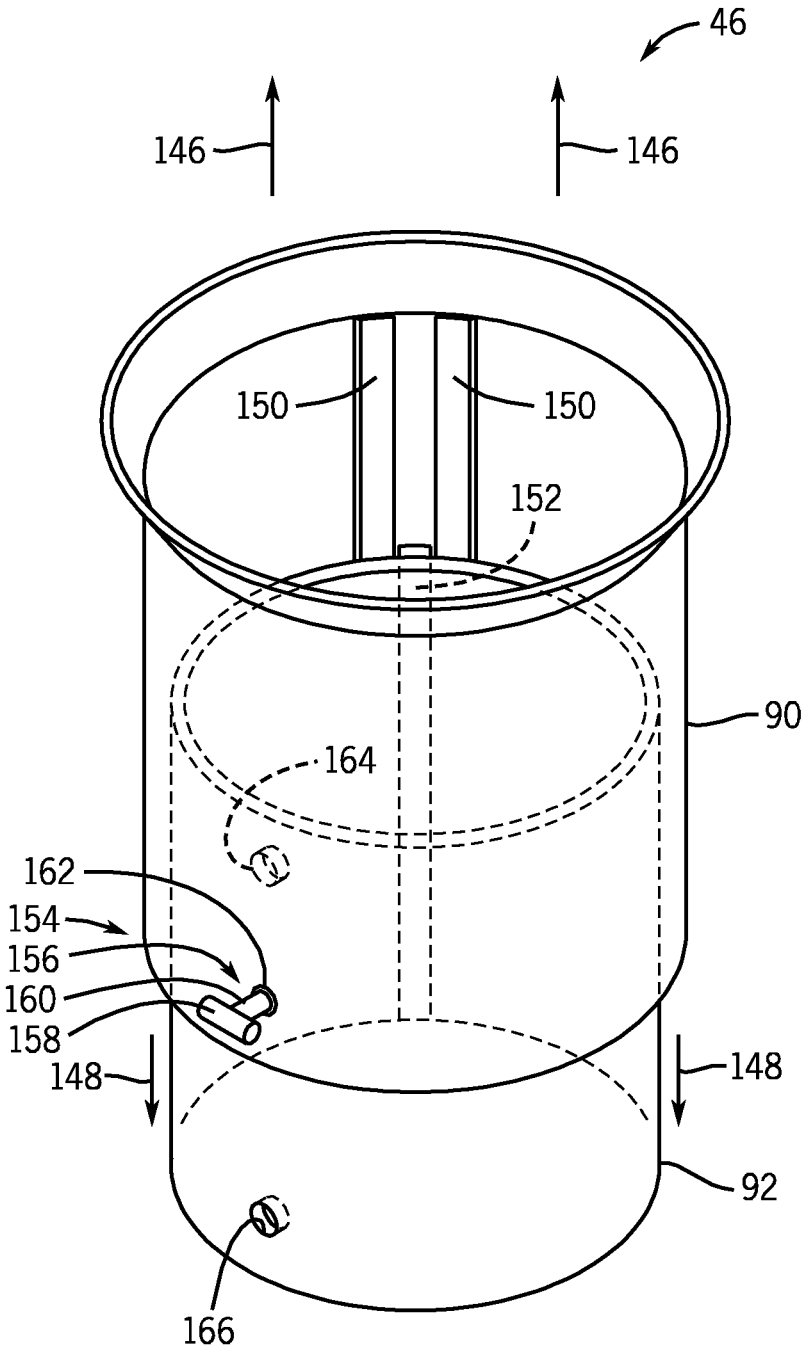
FIG. 7 is a perspective view of yet another embodiment of the funnel of FIG. 1.

FIG. 7 illustrates an embodiment of the funnel 46 that includes a telescopic extension 90. For example, the extension 90 includes an inside diameter that is slightly greater than the outside diameter of the bucket 92. Accordingly, the clearance between the extension 90 and the bucket 92 enables the extension 90 to be disposed around the bucket 92 and manipulated between a first position, where the extension 90 is atop the bucket 92, and a second position where the extension 90 is retracted to generally surround the bucket 92. For example, the extension 90 may be moved in the direction of arrows 146 to a first position, and may be moved in the direction of arrows 148 to a second position. Accordingly, the first position may provide the funnel 46 with an increased height, and the second position may provide the funnel 46 with a reduced height. In other embodiments, the arrangement of the extension 90 and the bucket 92 may be varied. For example, the extension 90 may include an outer diameter that is less than the inner diameter of the bucket 92, and thus, the extension 90 may be disposed internal to the bucket 92.

To provide for alignment of the extension 90 and the bucket 92, the funnel 46 includes alignment features. For example, the depicted extension 90 includes internal ribs 150 that are configured to accept a complementary rib 152 that is external to the bucket 92. Accordingly, the ribs 150 and 152 guide the relative movement of the extension 90 and the bucket 92. Other embodiments may include multiple alignment features, such as multiple ribs 150 and 152.

Further, an embodiment of the funnel 46 of FIG. 7 may include a locking mechanism 154 that is similar to the locking mechanism 132 discussed with regard to FIG. 3. For example, the locking mechanism 154 includes a latch pin 156 having a handle 158 and a stem 160. In operation, the stem 160 of the latch pin 156 is inserted into a receptacle 162. As depicted, the receptacle 162 includes a hole that passes through a wall of the extension 90. The bucket 92 includes a first receptacle 164 and a second receptacle 166 that are configured to accept the latch pin 156. Accordingly, when the extension 90 is manipulated in the direction of arrows 146 into the first (e.g. extended) position, the stem 160 may be inserted into the first receptacle 164. Similarly, when the extension 90 is manipulated in the direction of arrows 148 into the second (e.g. retracted) position, the stem 160 may be inserted into the second receptacle 166. Other embodiments may include a plurality of locking mechanisms 154 and/or other forms of locking mechanisms. For example, multiple receptacles may be provided in the bucket 92 such that the extension may be locked into a plurality of positions to provide any number of funnel heights.

As discussed above, the disclosed embodiments of the funnel 46 may be described as multi-part, at least partially movable to provide clearance, at least partially rotatable, variable height or height adjustable, telescopic, or a combination thereof. For example, the funnel 46 may include a plurality of hollow structures, guide channels, or funnel portions, such as funnel extension 90 and bucket 92. In some embodiments, the funnel extension 90 may be an after market add-on hinge assembly, telescopic assembly, locking mechanism, or a combination thereof. In other embodiments, the funnel extension 90 and bucket 92 may be an assembly originally installed with a mineral extraction system and/or component, or it may be sold as a replacement or retrofit assembly for an existing system. Other embodiments may provide the bucket 92 (without the extension 90) alone or in combination with a mineral extraction system and/or component, wherein the bucket 92 is designed to receive the funnel extension 90 at a later time. For example, the bucket 92 may include at least a portion of the hinge 122. In addition, the bucket 92 may be configured to couple with a variety of different funnel extensions 90 (e.g., different heights, diameters, chamfer sizes, etc.).

The funnel 46 may couple to various features of the mineral extraction system, including a well, a well head, a subsea christmas tree, a mineral deposit (e.g., oil and/or gas), a tool, a tool connector, a valve, a controller, a conduit/pipe, an offshore vessel at the surface, lines extending from the platform to the christmas tree, or a combination thereof.

The funnel extension 90, or the bucket 92, or both, may couple to a first component, a second component, or another portion of a mineral extraction system (e.g., subsea). For example, the first component may include a tool, a pipe, a cable, a control line (e.g., electrical, hydraulic, etc.), an ROV, a valve, a FAM or a combination thereof. By further example, the second component may include a choke, a valve, a christmas tree, or various other components. The funnel 46 may be configured to guide the first component to engage and/or connect with the second component of the mineral extraction system. As discussed above, the funnel extension 90 and/or the bucket 92 may have a hollow geometry (e.g., cylindrical and/or conical) with a tapered or chamfered portion to guide the first component progressively toward the second component (e.g., axial and radial alignment) if the funnel 46 is used to guide components, then the funnel extension 90 may be vertically stacked directly one over another with the bucket 92 such that the extension 90 and bucket 92 are coaxial with one another. If the funnel 46 is not in use and/or if access is needed in a nearby portion of the Christmas tree, then the extension may be moved out of the vertically stacked arrangement to another position providing clearance. For example, as discussed above, the extension may slide, rotate, or generally move to a side-by-side position and/or lowered position.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a two-part funnel configured to guide a first component through a passage extending through the two-part funnel and into position with respect to a second component of a mineral extraction system, comprising:

a hollow funnel base having a first axis; and a hollow funnel extension having a second axis, wherein the hollow funnel base and the hollow funnel extension are coupled by a joint, the hollow funnel extension is configured to be disposed in at least a first position and a second position relative to the position of the hollow funnel base, the first and second axes are coaxial in the first position, the first and second axes are offset or at an angle relative to one another in the second position, wherein the two part funnel is coupled to the mineral extraction system, wherein the mineral extraction system comprises a well, a wellhead, a subsea tree, a mineral deposit, a tool, a tool connector, a valve, a controller conduit, or a combination thereof.

2. The system of claim 1, wherein the hollow funnel base comprises a first height, the hollow funnel extension comprises a second height, and the hollow funnel base and the hollow funnel extension are configured to stack one over the other to provide a third height in the first position.

3. The system of claim 1, wherein the joint comprises a hinge rotatably coupling the hollow funnel base with the hollow funnel extension.

4. The system of claim 1, wherein the two-part funnel comprises a locking mechanism configured to secure the hollow funnel base and the hollow funnel extension with one another in the first position.

5. A system, comprising:

a hollow funnel extension configured to couple to a hollow funnel base of a mineral extraction system with a joint, wherein the hollow funnel extension is configured to be disposed in at least a first position and a second position relative to the hollow funnel base, the hollow funnel extension has a first axis, the hollow funnel base has a second axis, the first and second axis are coaxial in the first position, the first and second axes are offset or at an angle relative to one another in the second position, and the hollow funnel extension is configured to guide a first component into position with respect to a second component in the first position through a passage extending through the hollow funnel extension and the hollow funnel base, wherein the joint comprises a hinge configured to couple with the hollow funnel base, and the hinge comprises a hinge axis of rotation that extends along or parallel to the first axis.

6. The system of claim 5, wherein the hollow funnel extension is configured to rotate between the first position and the second position.

7. The system of claim 5, comprising the hollow funnel base coupled to the hollow funnel extension.

8. A system, comprising:

a subsea funnel configured to guide a first component into position with respect to a second component through a passage extending through the subsea funnel, the subsea funnel comprising a hollow funnel base, a hollow funnel extension, and hinge, wherein the hinge couples the hollow funnel base to the hollow funnel extension, the hollow funnel base has a first axis, the hollow funnel extension has a second axis, the first and second axes are coaxial in a first position of the hollow funnel extension, and the first and second axes are offset or at an angle relative to one another in a second position of the hollow funnel extension, wherein the subsea funnel is coupled to at least one component of a mineral extraction system, wherein the at least one component comprises a well, a wellhead, a subsea tree, a mineral deposit, a tool, a tool connector, a valve, a controller conduit, or a combination thereof.

9. The system of claim 8, wherein the hollow funnel extension of the funnel is configured to rotate about the hinge between the first position and the second position relative to the hollow funnel base.

10. The system of claim 8, wherein the hollow funnel base and the hollow funnel extension are configured to stack one over another in the first position, and the hollow funnel base and the hollow funnel extension are configured to be side-by-side in the second position.

11. The system of claim 8, wherein the hollow funnel base blocks access to a third component in the first position, and the hollow funnel base enables access to the third component in the second position, wherein the third component is proximate but external to the subsea funnel.

12. The system of claim 8, wherein the subsea funnel is configured to guide the first component to engage or connect with the second component of a mineral extraction system.

13. A system, comprising:

a hollow funnel extension configured to couple to a hollow funnel base of a mineral extraction system with a joint, wherein the hollow funnel extension is configured to be disposed in at least a first position and a second position relative to the hollow funnel base, the hollow funnel extension has a first axis, the hollow funnel base has a second axis, the first and second axis are coaxial in the first position, the first and second axes are offset or at an angle relative to one another in the second position, and the hollow funnel extension is configured to guide a first component into position with respect to a second component in the first position through a passage extending through the hollow funnel extension and the hollow funnel base, wherein the hollow funnel extension is configured to move telescopically relative to the hollow funnel base between the first position and the second position.

14. The system of claim 13, comprising the hollow funnel base coupled to the hollow funnel extension.

* * * * *